US008789304B2

(12) United States Patent
Engesser et al.

(10) Patent No.: US 8,789,304 B2
(45) Date of Patent: Jul. 29, 2014

(54) FIREARM AND COMPONENT CARRIER FOR A FIREARM

(71) Applicant: Steyr Mannlicher Holding GmbH, Kleinraming (AT)

(72) Inventors: Michael Engesser, Barsinghausen (DE); Christian Hösz, Oberpetersdorf (AT)

(73) Assignee: Steyr Mannlicher GmbH, Kleinraming (AT)

( * ) Notice: Subject to any disclaimer, the term of this patent is extended or adjusted under 35 U.S.C. 154(b) by 0 days.

(21) Appl. No.: 13/712,239

(22) Filed: Dec. 12, 2012

(65) Prior Publication Data

US 2014/0150318 A1 Jun. 5, 2014

(30) Foreign Application Priority Data

Nov. 30, 2012 (AT) ..... 50117/2012

(51) Int. Cl.
*F41C 23/16* (2006.01)
*F41A 21/48* (2006.01)

(52) U.S. Cl.
CPC ..... *F41C 23/16* (2013.01); *F41A 21/481* (2013.01)
USPC ..... 42/75.02; 42/75.01

(58) Field of Classification Search
CPC ..... F41C 23/16; F41A 21/481
USPC ..... 42/75.01, 75.02
See application file for complete search history.

(56) References Cited

U.S. PATENT DOCUMENTS

| | | | | |
|---|---|---|---|---|
| 5,513,461 | A | 5/1996 | Weldle | |
| 7,640,689 | B2 | 1/2010 | Fluhr | |
| 8,087,194 | B1 * | 1/2012 | Vuksanovich | 42/75.02 |
| 8,141,285 | B2 * | 3/2012 | Brown | 42/71.01 |
| 8,234,808 | B2 | 8/2012 | Lewis et al. | |
| 8,561,517 | B2 * | 10/2013 | Brown | 89/1.4 |
| 2012/0216439 | A1 | 8/2012 | Barrett et al. | |

FOREIGN PATENT DOCUMENTS

| | | | |
|---|---|---|---|
| DE | 102005036251 | B3 | 1/2007 |
| DE | 102005054917 | A1 | 5/2007 |
| WO | WO 2011044169 | A1 | 4/2011 |

OTHER PUBLICATIONS

Communication dated May 29, 2013 in the Austrian Priority Application with search report.

* cited by examiner

*Primary Examiner* — Stephen M Johnson
(74) *Attorney, Agent, or Firm* — Hoffmann & Baron, LLP

(57) ABSTRACT

The invention relates to a firearm and a component carrier therefor. The firearm has a barrel and a breech. The component carrier comprises a grip portion for receiving at least a portion of the barrel, a housing portion for receiving at least the breech, and a coupling member in a transition zone between said two portions for coupling the barrel with the breech. The grip portion is separated into a support part radially supporting the barrel, and a spacer part keeping the support part axially spaced from the coupling member. The spacer part is configured to receive the barrel with radial clearance.

20 Claims, 4 Drawing Sheets

FIREARM AND COMPONENT CARRIER FOR A FIREARM

CROSS-REFERENCE TO RELATED APPLICATION(S)

This application claims priority to Austrian Utility Model Application GM 50117/2012, filed on Nov. 30, 2012, the contents of which are hereby expressly incorporated by reference.

FIELD OF THE INVENTION

The present invention relates to a component carrier for a firearm, the firearm having a barrel and a breech that can be coupled to the barrel. The present invention also relates to a firearm comprising such a component carrier.

BACKGROUND

Component carriers of this type serve to attach, e.g., a telescopic sight, a residual light amplifier or a grenade launcher to the firearm and, at the same time carry the barrel and the breech, and in many cases additional breech parts, a trigger mechanism and/or the magazine of the firearm. Given the conditions under which they are used, many of these components are subjected to considerable stress. For example, when firing at a rapid rate of fire, the barrel is heated to approximately 350-400° C., which leads to a lengthening of the barrel. U.S. Pat. No. 8,234,808 B2 describes a one-piece component carrier in which only the breech-side end of the barrel is affixed so as to avoid mechanical stresses in the firearm whenever the length of the barrel changes and to allow the barrel to move freely with respect to the component carrier. However, suspending the barrel in this manner reduces the target accuracy since the barrel moves considerably relative to the sighting device which is generally attached to the component carrier. Therefore, the barrel is mounted as solidly as possible to the carrier component, e.g., by means of a bolt connection, and its removal from the component carrier is therefore very time-consuming; after a barrel has been removed and a new barrel has been attached, the firearm must be calibrated again.

SUMMARY

The present invention provides for a component carrier which securely holds the barrel and the breech block and which also provides a precise fit for the add-on components and at the same time allows the barrel to be rapidly changed.

In some embodiments, the invention is a component carrier for a firearm, the firearm having a barrel and a breech block, including a grip portion for receiving at least a portion of the barrel; a housing portion for receiving at least the breech block; and a coupling member in a transition zone between said two portions for coupling the barrel with the breech block, wherein the grip portion is separated into a support part radially supporting the barrel, and a spacer part keeping the support part axially spaced from the coupling member, which spacer part is configured to receive the barrel with radial clearance.

The support part provides the barrel with an additional axial guide as the barrel is inserted during a barrel change and with an additional radial support during use of the firearm, without the need for a second means for clamping the barrel to the component carrier. By virtue of the spacer part, the support part is positioned at a distance from the coupling member on the breech-side end of the barrel. Thus, the end of the barrel is coupled to the component carrier and, at a distance therefrom, additionally supported by the component carrier. Its position is therefore clearly defined, which increases the target accuracy. At the same, the support part makes it possible for a newly inserted barrel to be precisely aligned on the component carrier. Thus, the firearm does not need to be calibrated again. Because of the radial distance from the barrel, the grip portion is thermally insulated from the barrel and remains cool even if the barrel heats up. As a result of the fact that the grip portion is divided into a support part and a spacer part, the versatility of the component carrier is further increased, since it is possible for the shooter to use his/her own support parts for special barrels. In addition, the production of the component carrier is considerably simplified since, in order to create the larger inside diameter of the spacer part, it is no longer necessary for work to be done through the narrower opening of the support part, but instead the larger diameter can be easily created after removal of the support part.

The support part can be seated entirely within the spacer part; however, in some embodiments the support part extends the spacer part in the axial direction. As a result, it also extends the effect of the grip portion and of the component carrier. In some embodiments the support part can have a recessed portion which is inserted into the spacer part. Notwithstanding the simple assembly, this configuration ensures a clearly defined tight fit of the support part on or in the spacer part.

According to further embodiments, the support part can be mounted on the barrel. This makes it possible for a variety of very different barrels to be inserted into one and the same component carrier and to be mounted to it securely and in a manner that allows for a rapid barrel change. Alternatively, it is also possible for the support part to be mounted to the spacer part, which makes it easier for the barrel itself to be of a simpler construction and which facilitates a more rapid barrel change.

The coupling member is in some embodiments a bayonet coupling for an exchangeable barrel, and the component carrier is provided with a releasable lock for the bayonet coupling. Such a bayonet coupling makes it possible to especially rapidly and easily change barrels simply by inserting and rotational movement; at the same time, it is a durable, heavy-duty coupling that can be readily released even if the firearm is dirty.

In some embodiments the bayonet coupling comprises a bore in the aforementioned transition zone, with at least one inner toothed ring for engaging in a complementary outer toothed ring of the barrel and a stop for limiting the rotation of the barrel. Thus, forces that are generated are distributed over a plurality of teeth, and the barrel can be inserted in various positions, with a secure coupling being always ensured because of the limiting stop.

In some embodiments, the lock of the bayonet coupling acts between the support part and a counter piece of the component carrier, which counter piece can be mounted on the barrel. During use of the firearm, this region remains cooler than the breech-side end of the barrel, which has the effect that the lock is less thermally stressed and can be opened more easily. Furthermore, this allows the lock to be disposed within view of the shooter for inspection at any time.

In some embodiments the stop is disposed on the support part and interacts with a lug of the counter piece. This makes it easier to check the correct fit of the barrel on the component carrier.

A sturdy and simple configuration results if the support part comprises a movable locking bolt for engaging in a recess of the counter piece. In some embodiments, the locking bolt is spring-loaded and disposed in a bushing of the support part and can be actuated by means of an operating element which is guided in a slot of the wall of the bushing and/or the support part and which is accessible from the outside. This ensures that the locking bolt is securely and automatically engaged and can be easily operated, if necessary even with a gloved hand, provided that the operating element is suitably configured. In addition, the lock or the locked position can be checked from the outside, if necessary, even when the firearm is cocked.

For repeating the breech, modern firearm systems, e.g., of the AR-15 family, comprise a pressurized gas return system which returns gas tapped from the barrel directly to the breech carrier. As a result of this, the breech area becomes contaminated by powder residue and heats up considerably during use. This stress on the moving components and lubricants in this area makes such systems susceptible to malfunction.

According to further embodiments of the present invention, the counter piece comprises a cylinder/piston unit which is fed by a barrel tap, the piston of which cylinder/piston unit acts upon a rod assembly that is guided within the grip portion for repeating the breech. In addition to the advantages of greater reliability because of reduced contamination and lower thermal stress, another advantage is that such a unit shunts waste gases away from the face of the shooter.

In some embodiments the barrel tap comprises a pressure control valve. This allows the repeating mechanism to be adjusted to different bullets, to the degree of fouling on the firearm and/or to potential barrel add-on components, such as silencers, muzzle brakes, etc., as well as to situations in which automatic repeating of the breech is not desirable.

According to further embodiments, the coupling member for coupling the barrel and the breech is fitted exchangeably into the component carrier. This makes it possible to replace a highly stressed coupling member and allows continuing use of the component carrier. In cases in which very different types of barrels and breeches are used, it also allows the coupling member to be selected and used according to the types of such barrels and breeches. In addition, the number of processing steps required in the production of the component carrier can be reduced.

To make it easier to add on components, in particular standardized components, in some embodiments a mounting rail for add-on components can be attached to at least one side of the spacer part and the support part, which mounting rails are aligned relative to one another. The mounting rail of the spacer part can extend over the housing portion. This ensures a flexible, secure mounting platform even for long add-on components or for a plurality of add-on components, with the mounting rail possibly being configured, e.g., as a standardized Picatinny rail.

In some embodiments an additional mounting rail for add-on components can be attached to least one side of the counter piece, with the mounting rail being aligned relative to at least one of the aforementioned mounting rails. This not only extends the already existing rail but also creates a rail segment for mounting add-on components directly on the barrel.

In a further embodiment the invention is a firearm, including a barrel, a breech block and a component carrier, wherein the component carrier includes a grip portion for receiving at least a portion of the barrel, a housing portion for receiving at least the breech block, and a coupling member in a transition zone between said two portions for coupling the barrel with the breech block, and further wherein the grip portion is separated into a support part radially supporting the barrel, and a spacer part keeping the support part axially spaced from the coupling member and receiving the barrel with radial clearance.

BRIEF DESCRIPTION OF THE DRAWINGS

The present invention will be described in greater detail below based on a practical example shown in the enclosed drawings. In the drawings.

DETAILED DESCRIPTION

Figure 1:
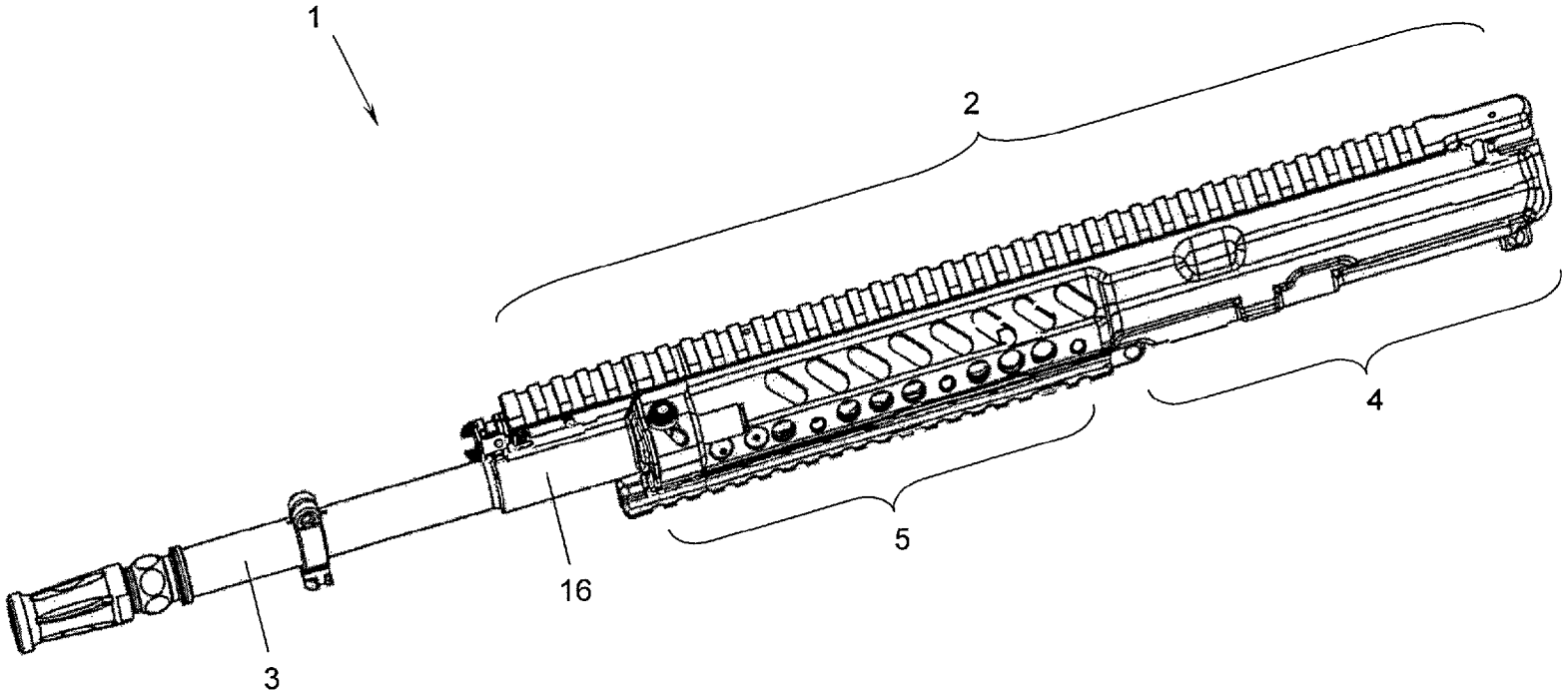
FIG. 1 illustrates a perspective top view of a component carrier according to the present invention, with the barrel having been inserted.

FIG. 1 shows a module 1 of a firearm. The module 1 comprises a component carrier 2 and a barrel 3 that is partly inserted therein. The component carrier 2 has a housing portion 4 and a grip portion 5. The housing portion 4 holds at least one breech block 6 with a firing pin 6' (FIGS. 4, 5); the housing portion 4 can also receive or hold additional parts of the breech and trigger mechanism as well as a magazine, a shaft, etc., of the firearm. The firearm can be a handgun, e.g., a semi-automatic handgun or automatic rifle.

Figure 2:
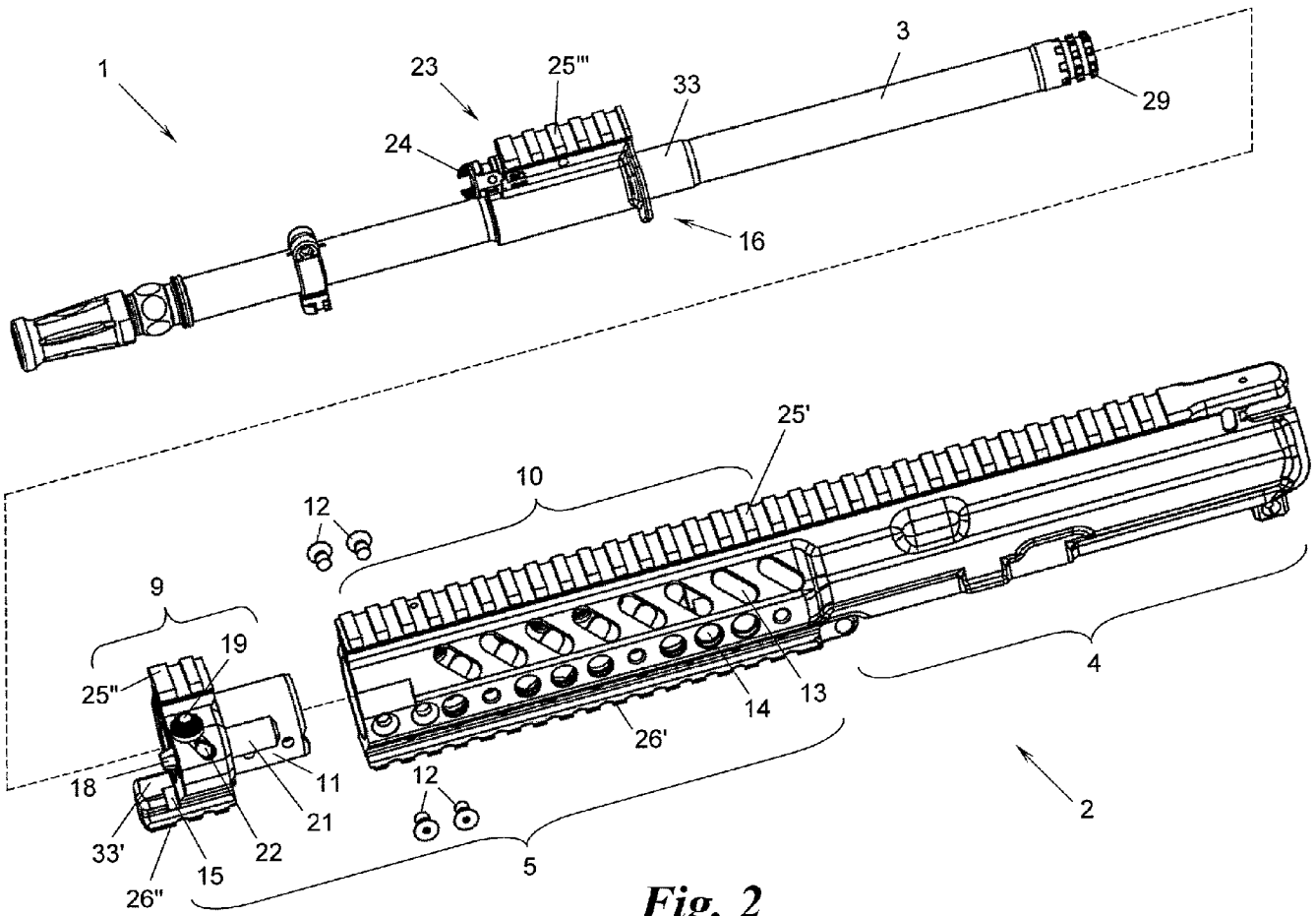
FIG. 2 illustrates a perspective view of the component carrier of FIG. 1, with the barrel having been removed and with the support part having been dismounted.

As shown in FIG. 2, the barrel 3 can be removed from the component carrier 2. In the example illustrated, the rear end on the breech side of barrel 3 is coupled within a coupling member 8 (FIGS. 4, 5) which is disposed in the transition zone between the housing portion 4 and the grip portion 5 in the component carrier 2, as will be explained in greater detail below. Inside the coupling member 8, the barrel 3 comprises a cartridge chamber 8'.

The grip portion 5 is divided into a support part 9 and a spacer part 10. The support part 9 comprises a recessed portion 11 which is inserted into the spacer part 10 and which can be mounted in this position. At the same time, the support part 9 extends the spacer part 10 in the axial direction, and the axial extension of the spacer part 10 defines the axial distance of the support part 9 from the coupling member 8.

In the example shown in FIG. 2, the support part 9 in the area of its recessed portion 11 is mounted on the spacer part 10 by means of two screw pairs 12. Alternatively, however, it is also possible for it to be mounted on the barrel 3. The support part 9 could also be configured, e.g., without a recessed portion 11 and be mounted without axial overlap on the spacer part 10 or on the barrel 3. In addition, the support part 9 could have the form of a bushing and be located entirely inside the spacer part 10. Instead of using screws 12 for mounting the support part 9 on the spacer part 10 or on the barrel 3, it is also possible to use any other means known in the art.

The walls of the spacer part 10 are interspersed with cooling apertures 13, which in this case have an oblong configuration. The spacer part is radially spaced from the barrel 3 contained therein, i.e., its inside diameter is larger than the outside diameter of the barrel 3, which results in a radial clearance "a", see FIGS. 4 and 5. The cooling apertures 13 allow air to circulate around the barrel 3 inside the spacer part 10 and the grip portion 5. In addition, the spacer part 10 also has lateral apertures, which in this example have an approximately circular shape, for mounting and/or supporting add-on components, firearm slings, etc.

Figure 7:
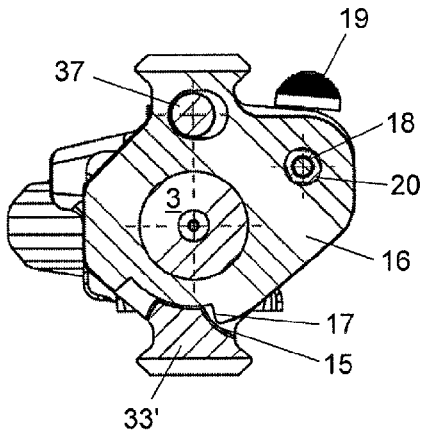
FIG. 7 illustrates a cross section through the component carrier of FIG. 4 along the section line D-D of FIG. 4.

When the barrel 3 is inserted into the component carrier 2 and coupled to the coupling member 8 by means of a rotational movement, the rotation of the barrel 3 is limited by a stop 15 on the support part 9. To this end, the component carrier 2 comprises a counter piece 16 which, as shown in FIG. 2, is mounted on the barrel 3, e.g., by means of shrink fitting. The counter piece 16 has a lug 17 (FIG. 7) which interacts with the stop 15 on the support part 9. The stop 15 could also be disposed directly in the coupling member 8 (either in addition or as an alternative thereto) or at another point on the component carrier 2 where it can interact with a different lug of the barrel 3.

The coupling of the barrel 3 in the coupling member 8 of the component carrier 2 can be locked. To this end, a moving locking bolt 18 with an operating element 19 is disposed on the support part 9, which locking bolt can engage in a recess 20 on the counter piece 16 when the barrel 3 and the counter piece 16 are rotated relative to the support part 9, and thus locks the barrel 3 into its coupled position. As an alternative, the stop 15 and/or the locking bolt 18 can also be disposed on the counter piece 16 and thus act and lock relative to the support part 9 and/or the spacer part 10. If the support part 9 is mounted on the barrel 3, the lock is similarly implemented between the support part 9 and the spacer part 10.

In the example illustrated, the locking bolt 18 is disposed in a bushing 21 of the support part 9 and is actuated by a compression spring 21' (FIG. 7) in the locking direction. The operating element 19, which projects from the side of the locking bolt 18, is disposed in a slot 22 that penetrates the wall of the bushing 21 and/or the support part 9 and thus is accessible from the outside. The longitudinal axis of the locking bolt 18 runs approximately parallel to the axis of the barrel 3 and the component carrier 2. The slot 22 runs obliquely to said axis so that rotating the locking bolt 18 about its axis by means of the operating element 19 leads to an axial displacement of the locking bolt 18 inside the bushing 21 and thus causes it to engage in or disengage from the recess 20. It is obvious that the slot 22 can also run in a different direction, e.g., parallel to the axis of the locking bolt 18, or it can be entirely omitted if the locking bolt 18 is operated by different means.

To return the gas for a gas pressure controlled breech, the counter piece 16 can also comprise a cylinder/piston unit 23 with a pressure control valve 24 (FIG. 6), as will be described in greater detail below.

On the spacer part 10, the support part 9 and/or the counter piece 16, (at least) one upper and/or lower and/or lateral mounting rail 25', 25", 25''', 26', 26" for add-on components can be disposed. The mounting rail 25' of the spacer part 10 can also extend in part or in its entirety over the housing portion 4. In some embodiments, the mounting rails 25', 25", 25", 26', 26" used are standardized rails, e.g., Picatinny rails. Assembling the aforementioned parts of the component carrier 2 makes it possible to create an upper mounting rail 25', 25", 25' and a lower mounting rail 26', 26" each of which is in alignment, i.e. runs straight, over the entire length of said component carrier. Another possibility would be to mount additional lateral mounting rails along the lateral apertures 14 of the spacer part 10, or not to dispose mounting rails on all aforementioned parts and/or to dispose the mounting rails 25', 25", 25''', 26', 26" nonparallel to the longitudinal axis of the component carrier 2.

Figure 3:
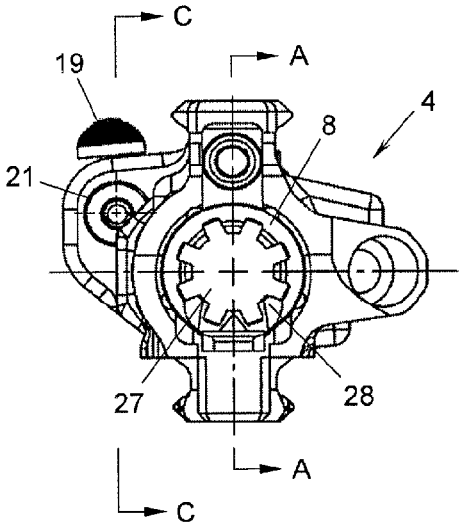
FIG. 3 illustrates a rear view of the component carrier of FIG. 2.

The function of the coupling member 8 will be explained in greater detail with reference to FIGS. 3-5. As seen in FIG. 3, the coupling member 8 comprises an axial bore 27 with one or more (in this case: two) axially spaced inner toothed rings 28 for engaging in one or more complementary outer toothed rings 29 that are disposed on the barrel 3 (FIG. 2). Thus, the barrel 3 and the coupling member 8 form a bayonet coupling, the stop for limiting the rotation is, as discussed earlier, formed by the lug 17 and the stop 15.

The coupling member 8 is in some embodiments, not mandatorily, a separate element that is permanently or exchangeably inserted into the component carrier 2. In the latter case, the coupling member 8 can be held, e.g., by a threaded sleeve 30 that is screwed into the component carrier 2, and this threaded sleeve can be affixed by means of a threaded bolt 31. To make it easier to insert the barrel 3, the inside of the threaded sleeve 30 can have a conical shape. It is obvious that the coupling member 8 could also be affixed in the component carrier 2 by any other means known from the prior art and/or could be constructed in one piece, i.e., as an integral part of the component carrier 2.

The support part 9 can comprise a sliding sleeve 32 that guides the barrel 3 during insertion into the component carrier 2 and during coupling in the coupling member 8 and that supports said barrel during use of the firearm with very low clearance, i.e., with a slightly loose fit, in the radial direction. To improve the support in the radial direction, the barrel 3 can be fitted with an additional, e.g., circumferential, shoulder 33.

An optional axial guide extension 33' on the support part 9 makes it easier to insert the barrel 3 into the support part 9. In this case, the stop 15 can be, e.g., a notch in the guide extension 33' and thus hold the lug 17 of the counter piece 16 in the axial direction, with sufficient clearance to absorb the heat-induced lengthening of the barrel 3.

Figure 6:
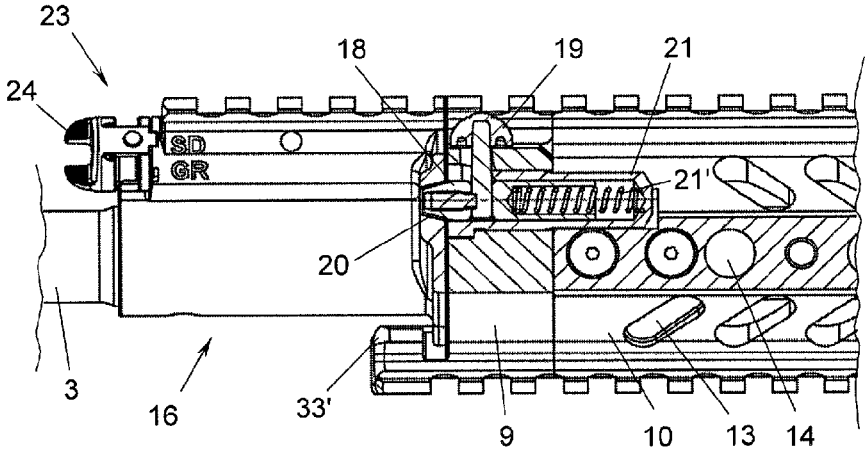
FIG. 6 illustrates a sectional detail of the component carrier along the section line C-C of FIG. 3.
Figure 4:
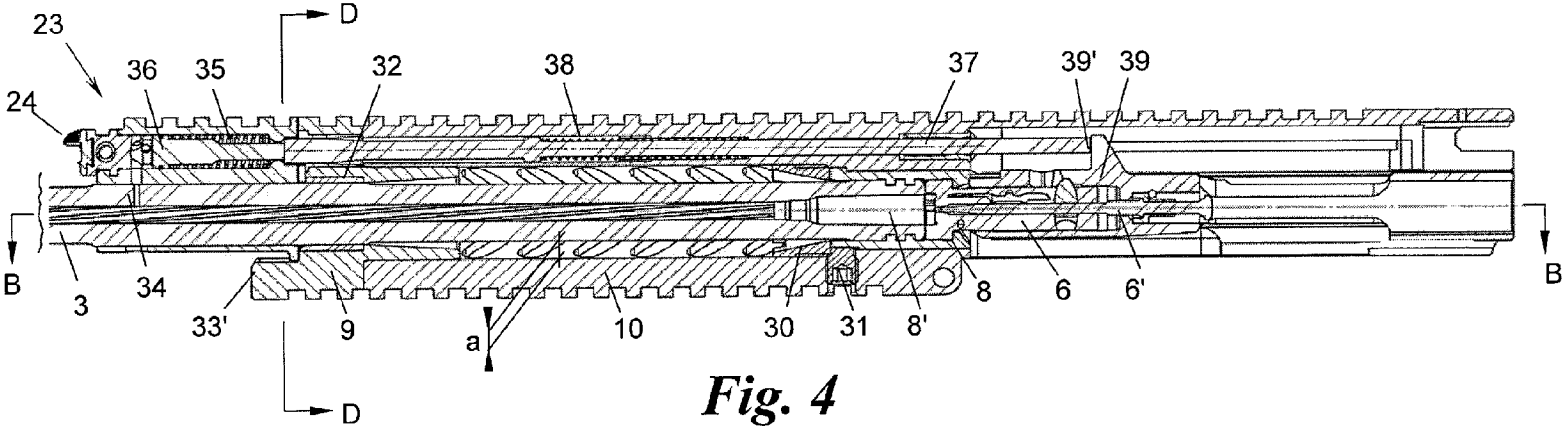
FIG. 4 illustrates a longitudinal section through the component carrier with inserted barrel and breech along the section line A-A of FIG. 3.
Figure 5:
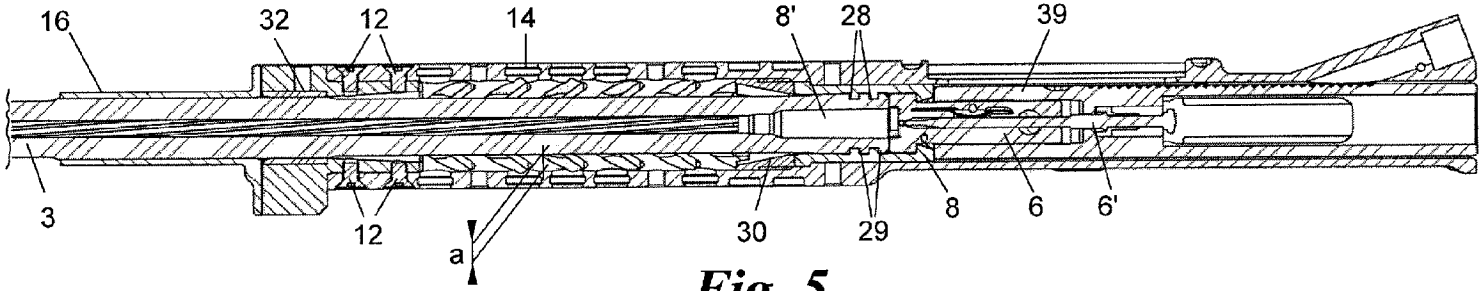
FIG. 5 illustrates a longitudinal section through the component carrier of FIG. 4 along the section line B-B of FIG. 4.

FIGS. 4 and 6 show a detailed illustration of the gas drive for repeating the breech 6 by means of the cylinder/piston unit 23 of the counter piece 16. When a shot is fired, the cylinder/piston unit 23 is supplied via a barrel tap 34 with pressurized gas from the barrel 3. The gas pressure drives a piston 36, which is loaded by a spring 35, of the cylinder/piston unit 23 against the spring force in the direction of the breech block 6. The piston 36 transmits the received pulse to a rod assembly 37 which is guided in a bore 38 in the grip portion 5, which bore runs approximately parallel to the axis of the barrel, and this rod assembly then transmits the pulse to the breech block 6 or and/a lug 39' of a breech carrier 39 so as to repeat the breech 6.

The rod assembly 37 could optionally also be divided, e.g., between the support part 9 and the spacer part 10, and/or comprise additional lever or gear transmissions and/or, if desired, run at least in part outside the component carrier 2. The pressurized gas could also be supplied directly to the breech block 6 or breech carrier 39 without a cylinder/piston unit 23 and/or rod assembly 37, e.g., by passing through the aforementioned bore 38 in the grip portion 5.

The quantity of gas tapped from the barrel tap 34 and/or the gas pressure for the cylinder/piston unit 23 can be adjusted by means of the optional pressure control valve 24. The pressure control valve 24 changes the effective diameter of the barrel tap 34, e.g., via an adjusting screw; however, any other type of pressure control valve known in the prior art could be used as well.

The present invention is not limited to the embodiments described, but includes all variations, combinations and modifications that fall within the scope of the appended claims.

What is claimed is:

1. A component carrier for a firearm, the firearm having a barrel and a breech block, comprising:

a grip portion for receiving at least a portion of the barrel, a housing portion for receiving at least the breech block, and a coupling member in a transition zone between the grip portion and housing portion for coupling the barrel with the breech block, wherein the grip portion is separated into at least two component parts comprising a support part radially supporting and axially guiding the barrel, and a spacer part keeping the support part axially spaced from the coupling member, which spacer part is configured to receive the barrel with radial clearance, and wherein the support part is mounted on the spacer part.

2. The component carrier of claim 1, wherein the support part extends from the spacer part in an axial direction.

3. The component carrier of claim 2, wherein the support part has a recessed portion inserted into the spacer part.

4. The component carrier of claim 1, wherein the coupling member forms a bayonet coupling for an exchangeable barrel, and wherein the component carrier is provided with a releasable lock for the bayonet coupling.

5. The component carrier of claim 4, wherein the bayonet coupling comprises a bore in said transition zone with at least one inner toothed ring for engagement of a matching outer toothed ring of the barrel, and a stop for limiting a rotation of the barrel.

6. The component carrier of claim 5, wherein the lock of the bayonet coupling acts between the support part and a counter piece which can be mounted on the barrel, and wherein the stop is formed on the support part and cooperates with a lug of the counter piece.

7. The component carrier of claim 4, wherein the lock of the bayonet coupling acts between the support part and a counter piece which can be mounted on the barrel.

8. The component carrier of claim 7, wherein the support part comprises a movable locking bolt for selectively engaging a recess of the counter piece.

9. The component carrier of claim 8, wherein the locking bolt is spring loaded and received in a bushing of the support part, and wherein an operating element accessible from outside actuates said locking bolt, which operating element is guided in a slot of a wall of one or more of the bushing and the support part.

10. The component carrier of claim 7, wherein the counter piece comprises a cylinder-piston unit fed by a barrel tapping, and wherein the piston acts upon a rod assembly guided in the grip portion for rapid firing.

11. The component carrier of claim 10, wherein the barrel tapping is provided with a pressure control valve.

12. The component carrier of claim 7, wherein the counter piece carries on at least one side a further mounting rail.

13. The component carrier of claim 1, wherein the coupling member is fitted exchangeably into the component carrier.

14. The component carrier of claim 1, wherein each of the spacer part and the support part carries on at least one side a mounting rail, said mounting rails being mutually aligned.

15. The component carrier of claim 14, wherein the mounting rail of the spacer part extends over the housing portion.

16. The component carrier of claim 1, wherein the spacer part includes a larger diameter bore than the bore of the support part.

17. A firearm, comprising:

a barrel, a breech block and a component carrier, wherein the component carrier comprises:

a grip portion for receiving at least a portion of the barrel, a housing portion for receiving at least the breech block, and a coupling member in a transition zone between said two portions for coupling the barrel with the breech block; and wherein the grip portion is separated into at least two components comprising a support part radially supporting and axially guiding the barrel, and a spacer part keeping the support part axially spaced from the coupling member and receiving the barrel with radial clearance; the coupling member forms a bayonet coupling for an exchangeable barrel and the component carrier is provided with a releasable lock for the bayonet coupling; and further wherein the lock of the bayonet coupling acts between the support part and a counter piece mounted on the barrel.

18. The component carrier of claim 17, wherein the support part is configured to be mounted on the barrel.

19. The component carrier of claim 17, wherein the support part is mounted on the spacer part.

20. A component carrier for a firearm, the firearm having a barrel and a breech block, comprising:

a grip portion for receiving at least a portion of the barrel, a housing portion for receiving at least the breech block, and a coupling member in a transition zone between said the grip portion and housing portion for coupling the barrel with the breech block, wherein the grip portion is separated into a support part radially supporting the barrel, and a spacer part keeping the support part axially spaced from the coupling member, which spacer part is configured to receive the barrel with radial clearance, and wherein the support part is mounted on the spacer part, wherein the coupling member forms a bayonet coupling for an exchangeable barrel, and wherein the component carrier is provided with a releasable lock for the bayonet coupling, wherein the lock of the bayonet coupling acts between the support part and a counter piece which can be mounted on the barrel, wherein the support part comprises a movable locking bolt for selectively engaging a recess of the counter piece, the locking bolt is spring loaded and received in a bushing of the support part, and wherein an operating element accessible from outside actuates said locking bolt, which operating element is guided in a slot of a wall of one or more of the bushing and the support part.

* * * * *